United States Patent [19]

Miura

[11] Patent Number: 4,608,485

[45] Date of Patent: Aug. 26, 1986

[54] AUTOMATIC TRANSFER TRANSACTION PROCESSING APPARATUS

[75] Inventor: Kenji Miura, Nagoya, Japan

[73] Assignee: Kabushiki Kaisha Toshiba, Kawasaki, Japan

[21] Appl. No.: 634,266

[22] Filed: Jul. 25, 1984

[30] Foreign Application Priority Data

Jul. 25, 1983 [JP] Japan ..... 58-135414
Mar. 22, 1984 [JP] Japan ..... 59-53527

[51] Int. Cl.[4] ..... G06R 15/30
[52] U.S. Cl. ..... 235/379
[58] Field of Search ..... 235/379

[56] References Cited

U.S. PATENT DOCUMENTS 4,511,970 4/1985 Okano ..... 235/379

FOREIGN PATENT DOCUMENTS 1407660 9/1975 United Kingdom .

*Primary Examiner*—Harold I. Pitts
*Attorney, Agent, or Firm*—Cushman, Darby & Cushman

[57] ABSTRACT

An automatic transfer transaction processing apparatus has a passbook/transfer card printing/reading section for issuing a transfer card printed with transfer information as the bank name, branch name, account number, item number and name of the account of the transferee and the name and phone number of the transferer or the name and account information of the transferer. The transfer card has a magnetic stripe for storing the transfer information. When this transfer card is inserted in the passbook/transfer card printing/reading section on a subsequent occasion, the section reads the transfer information therefrom, which is then processed by the automatic transfer transaction processing apparatus.

6 Claims, 15 Drawing Figures

AUTOMATIC TRANSFER TRANSACTION PROCESSING APPARATUS

BACKGROUND OF THE INVENTION

The present invention relates to an automatic transfer transaction processing apparatus in an automatic banking apparatus such as an automatic teller machine capable of transferring cash from one given financial institution to another.

Automatic banking apparatuses have been greatly developed as automatic transaction processing equipment. These automatic banking apparatuses include: an automatic cash dispensing apparatus which automatically dispenses bank notes whose total amount is specified by a customer, while the apparatus communicates with a host computer to confirm whether or not the withdrawal transaction process can be performed in accordance with account information from a stripe on an inserted magnetic ID card of this customer; another automatic cash dispensing apparatus which automatically dispenses bank notes whose total amount is specified by a customer, while the apparatus communicates with the host computer to confirm whether or not the withdrawal transaction process can be performed in accordance with account information from a stripe on an inserted passbook; an automatic deposit transaction processing apparatus which automatically receives several bank notes inserted all at once with a passbook having an account information magnetic stripe; and an automatic teller machine which performs an automatic withdrawal transaction process and an automatic deposit transaction process. With these types of automatic banking equipment, financial institutions, such as banks, offer better service to their customers.

Another automatic teller machine has recently been developed. According to this automatic teller machine, cash is recieved and automatically transferred to an account of a different bank, or a desired amount specified by a customer can be automatically transferred from his own account to an account of a different bank.

However, all pieces of transfer information such as the transfer amount, the name of the designated financial institution, the branch name, the account number, the item, the name of the account, and the transferer's name and telephone number must be typed in for every transaction. The name of the account and the transferer's name and telephone number may be replaced with a transferer's name and account number. Even when the transfer operations are periodically performed for the same transferee, all input operations must be performed for every transaction, thereby resulting in a cumbersome operation.

SUMMARY OF THE INVENTION

It is an object of the present invention to provide an automatic transfer transaction processing apparatus capable of simplifying the key input operation for the transfer transaction.

In order to achieve the above object of the present invention, there is provided an automatic transfer transaction processing apparatus comprising:

input means for entering transfer information;

transfer transaction processing means for performing the transfer transaction process in accordance with the transfer information entered at said input means;

card-like medium issuing means for issuing a card-like medium having at least part of the transfer information entered at said input means when the transfer transaction process is finished; and reading means for reading the card-like medium.

According to the present invention, when a customer selects the issuance of a transfer card at the time of a transfer transaction, the automatic transfer transaction processing apparatus records transfer information on the transfer card and issues a card to the customer. When the customer wishes to perform another transfer transaction later on and inserts the transfer card, the apparatus automatically reads the transfer information from the transfer card, and thereby performs the transfer transaction process in accordance with the read information.

According to the automatic transfer transaction processing apparatus, when the customer periodically wishes to perform transfer transactions for the same transferee, he uses the transfer card and enters only a transfer amount or cash amount in the second and subsequent transactions. As a result, the customer can greatly shorten the key input time, thereby offering better service and improving the utilization efficiency of the transfer transaction process.

BRIEF DESCRIPTION OF THE DRAWINGS

Other objects and features of the present invention will be apparent from the following description with the accompanying drawings, in which.

DETAILED DESCRIPTION OF THE PREFERRED EMBODIMENT

Figure 1:
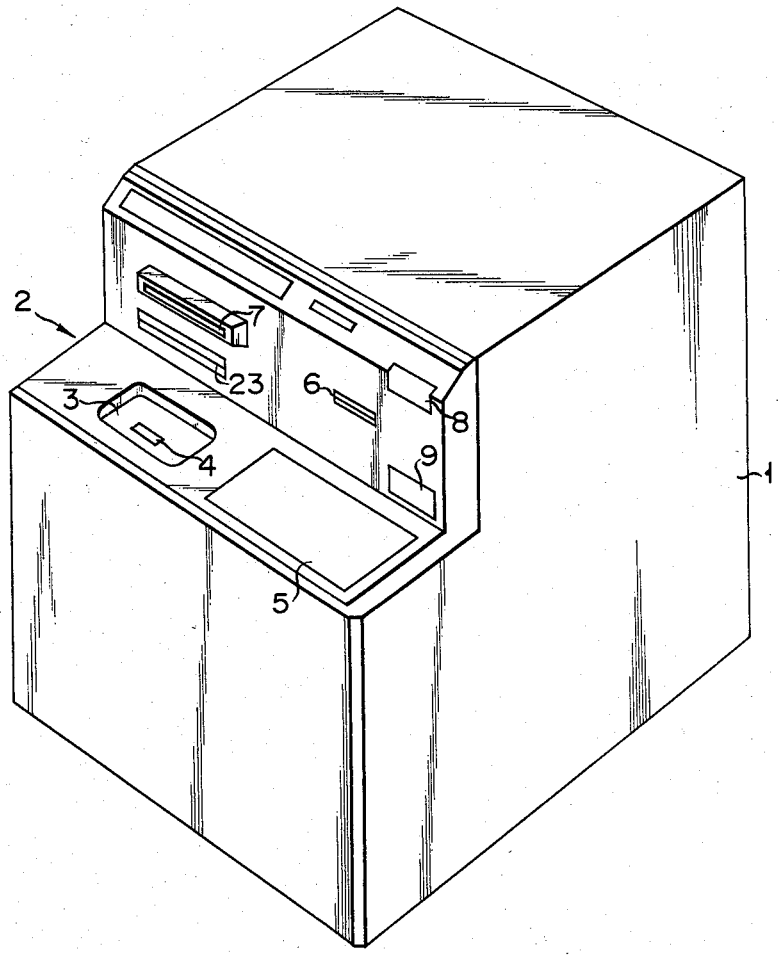
FIG. 1 is a perspective view showing the outer appearance of an automatic transfer transaction processing apparatus according to the present invention.
Figure 2:
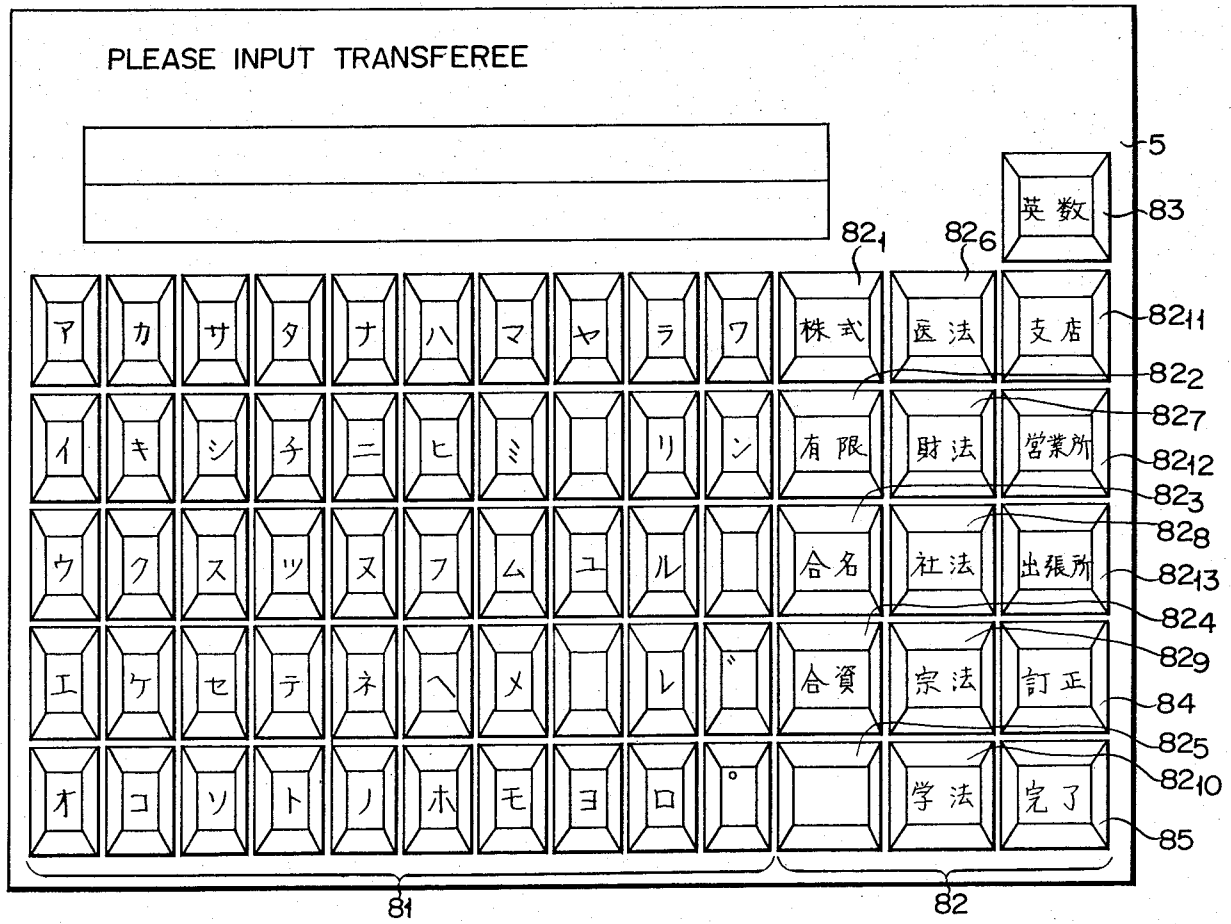
FIG. 2 is a plan view showing a display state of a CRT display unit in the apparatus of FIG. 1.

FIG. 1 shows an automatic teller machine as an automatic transfer transaction processing apparatus according to an embodiment of the present invention. An L-shaped operating section 2 is formed at the front side of a housing 1. A bank note inserting/dispensing port 3 is formed in a horizontal panel of the operating section 2 to receive a number of bank notes to be transferred or remitted at once or to dispense small change. A door 4 is mounted on the bank note inserting/dispensing port 3 to be opened/closed as needed. A color CRT display unit 5 incorporating a touch sensor is arranged on the horizontal panel of the operating section 2. The CRT display unit 5 displays illustrations, characters or messages for operating procedures and any other necessary information on a CRT screen so as to instruct the customer. When the customer depresses portions of the CRT display unit 5 which correspond to a keycode, an amount, an account number and an approval, confirmation or cancellation of a transfer transaction, a touch sensor (not shown) detects the key input signals supplied to a main control section 11 (to be described later). As shown in FIG. 2, the message "PLEASE INPUT TRANSFEREE", katakana keys 51 for entering a transferer's name, business type keys 82 for specifying the type of business of a transferee, an alphanumeric key 83, a correction key 84 and an end key 85 are displayed on the CRT screen. The business type keys 82 comprise a key $82_1$ representing a limited company, a key $82_2$ representing a limited responsibility company, a key $82_3$ representing an unlimited partnership, a key $82_4$ representing a limited partnership, a key $82_6$ representing a medical corporation, a key $82_7$ representing a foundation, a key $82_8$ representing a corporation, a key $82_9$ representing a religious corporation, a key $82_{10}$ representing a school corporation, a key $82_{11}$ representing a branch, a key $82_{12}$ representing a business office, and a key $82_{13}$ representing a branch office. When the operation step changes, the display contents change.

A card inserting/dispensing port 6 for inserting an ID card having account information, such as a keycode and an account number, and then dispensing it after the operation has been completed, a passbook/transfer card insertion port 7 for inserting a passbook or a transfer card 10 (FIG. 5), a receipt dispensing port 23 for dispensing a receipt, a coin insertion port 8 for inserting coins, and a coin dispensing port 9 for dispensing coins are formed in the vertical panel in the operation section 2.

Figure 3:
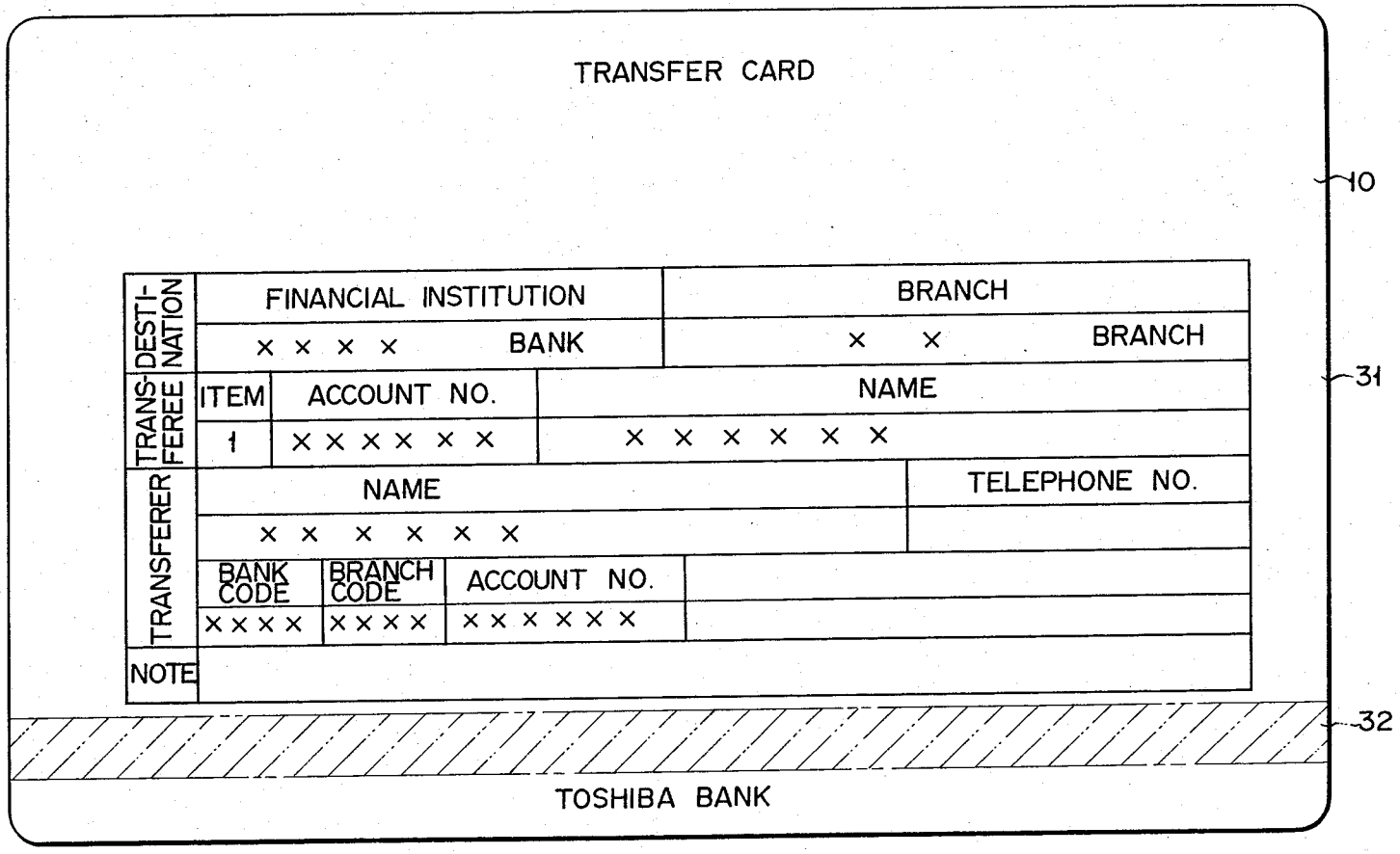
FIGS. 3 and 4 are plan views showing transfer cards having different types of transfer information thereon, respectively.
Figure 4:
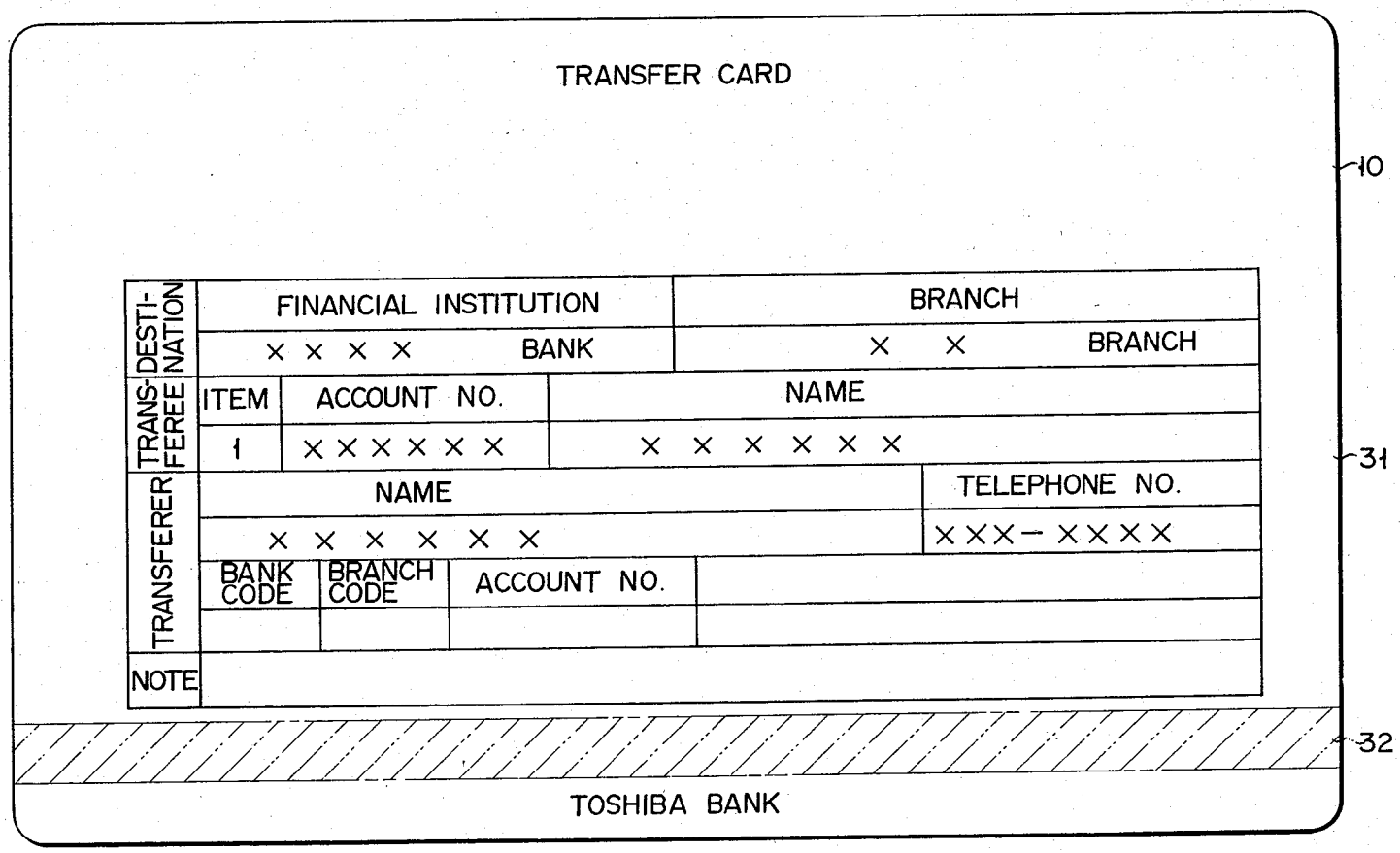

As shown in FIGS. 3 and 4, the transfer cards 10 have on their surfaces 31 destination information, i.e., the name and the branch name of the financial institution holding the transferee's account, and transferee information comprising the item number, the account number and account name thereof. However, as for information of the transferer, the transfer card 10 of FIG. 3 has the transferer name, the bank code, the branch code and the account number thereof, while the transfer card 10 of FIG. 4 has the transferer name and telephone number. In each card, a magnetic stripe 32 is formed on the rear surface of the transfer card to store the transfer information.

Figure 5:
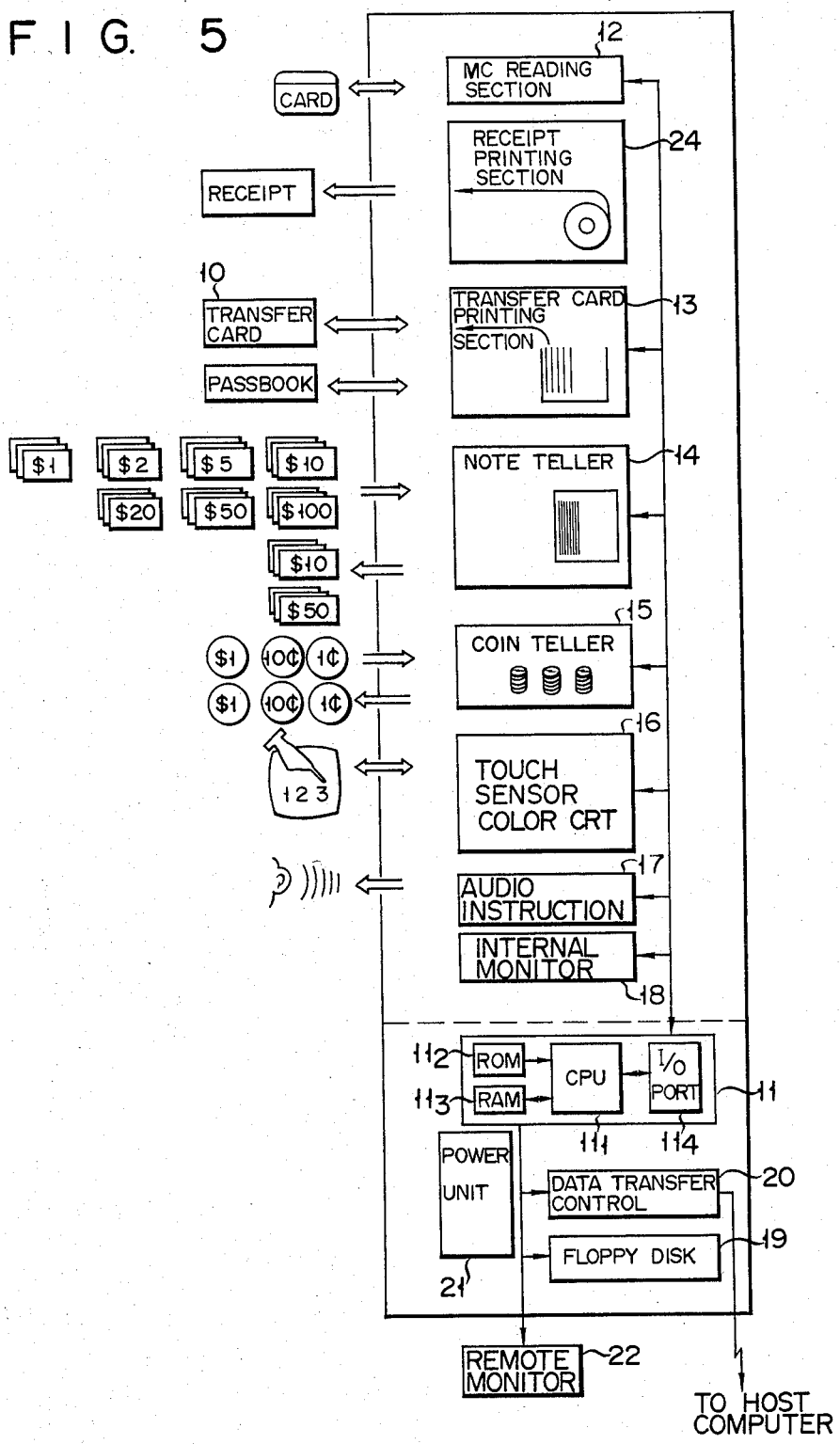
FIG. 5 is a block diagram showing the internal configuration of the automatic transfer transaction processing apparatus shown in FIG. 1.

As shown in FIG. 5, the housing 1 includes: the main control section 11 for controlling the overall operation of the automatic transfer transaction process; an MC reading section 12 for receiving an ID magnetic card (MC) inserted in the card inserting/dispensing port 6 and reading account information such as a keycode and an account number from the magnetic stripe 32; a passbook/transfer card printing/reading section 13 for reading information from the magnetic stripe on the passbook inserted in the passbook/transfer card insertion port 7, recording a transaction content on the passbook and journal paper, dispensing the transfer card 10 printed and recorded with the transfer information of the transfer transaction, or reading the transfer information from the magnetic stripe 32 of the transfer card 10 inserted from the passbook/transfer card insertion port 7; a receipt printing section 24 for dispensing a transaction result printed receipt from the receipt dispensing port 23; a note teller 14 for receiving bank notes inserted in the bank note inserting/dispensing port 3 and dispensing a specified amount of bank notes from the port 3; a coin teller 15 for receiving coins inserted from the coin insertion port 8 and dispensing a specified amount of coins from the coin dispensing port 9; a touch sensor color CRT 16 which comprises the CRT display unit 5; an audio instruction unit 17 for instructing the customer by producing an audio message from a loudspeaker (not shown); a personnel internal monitor 18; a floppy disk 19 for storing transaction data; a data transfer control 20 for controlling data transfer between the main control section 11 and a host computer (not shown); and a power unit 21.

The main control section 11 comprises a one-chip microcomputer which includes a central processing unit (CPU) $11_1$, a read only memory (ROM) $11_2$ for storing a control program shown in the flow charts of FIGS. 7A through 7I, a random access memory (RAM) $11_3$ used as a work area for arithmetic operation of data or the like, and an I/O port $11_4$ for controlling the input/output operation of data with the respective units of the automatic transfer transaction processing apparatus. The one-chip microcomputer comprises, for example, an i8086 available from Intel Corp., U.S.A. An external remote monitor 22 for personnel use is connected to the main control section 11.

Figure 6:
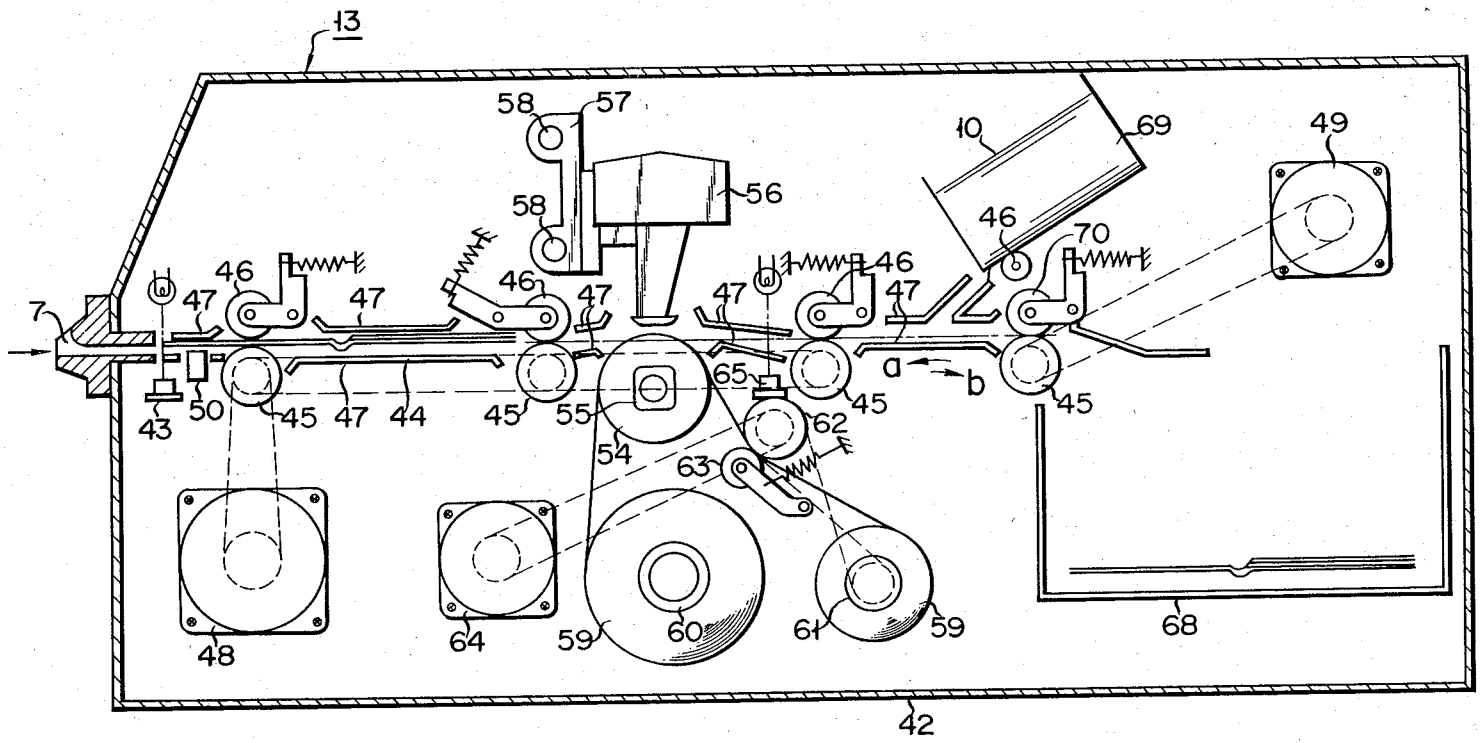
FIG. 6 is a sectional view of a transfer card printing section shown in FIG. 5.
Figure 7A:
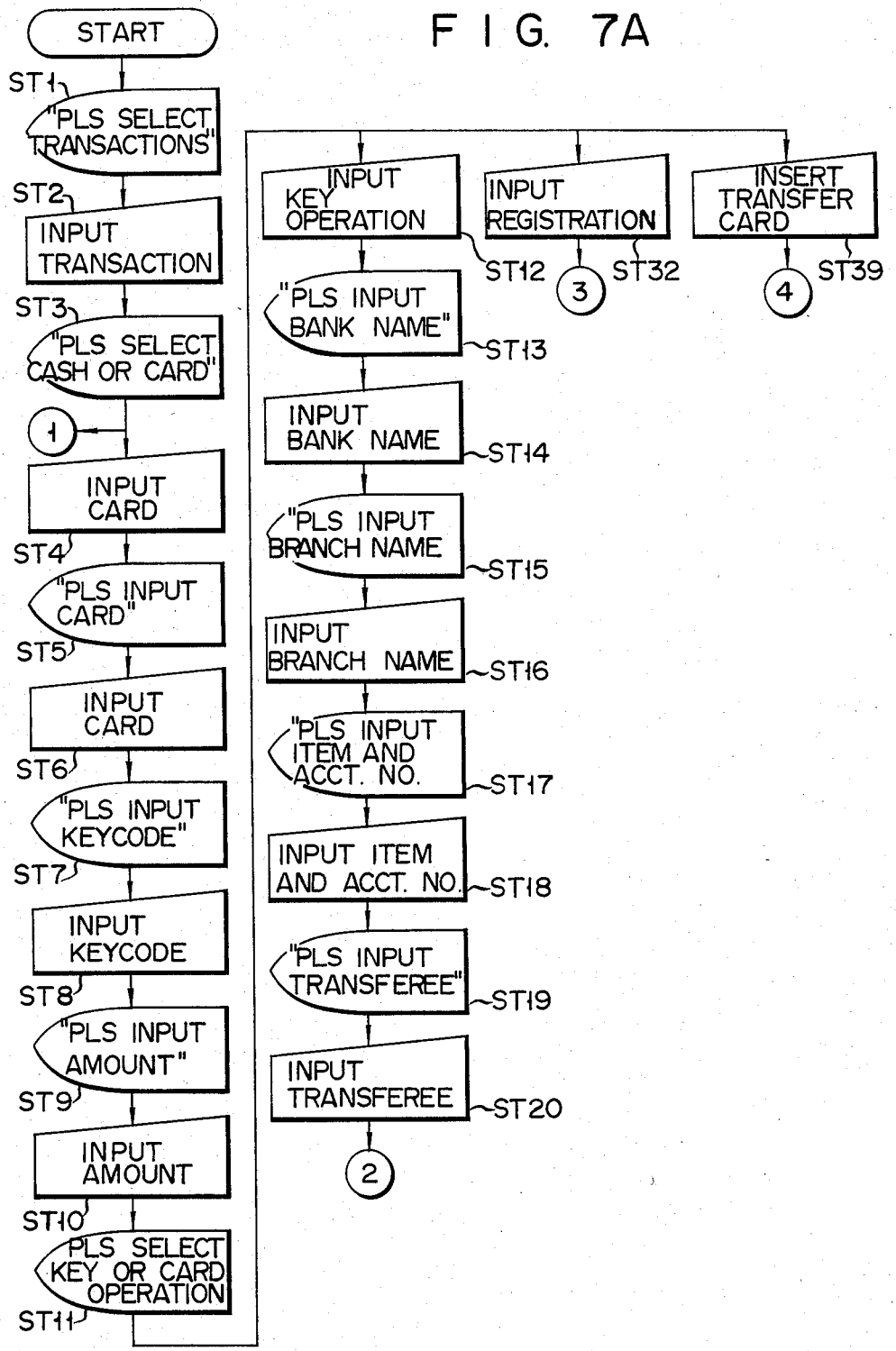
FIGS. 7A through 7I are respectively flow charts for explaining the operation of the automatic transfer transaction processing apparatus of FIG. 1.
Figures 7B, 7C, 7D:
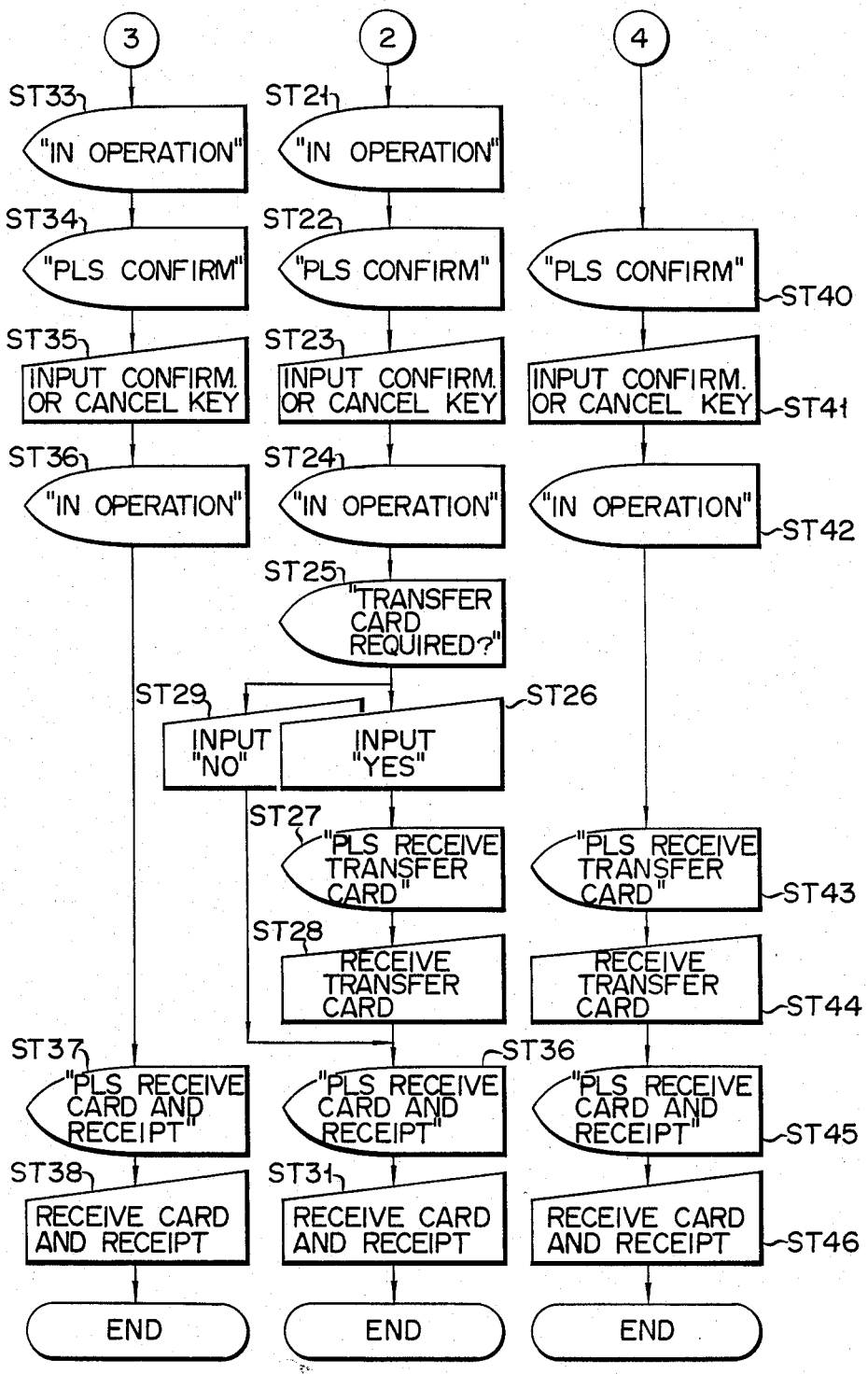
Figure 7E:
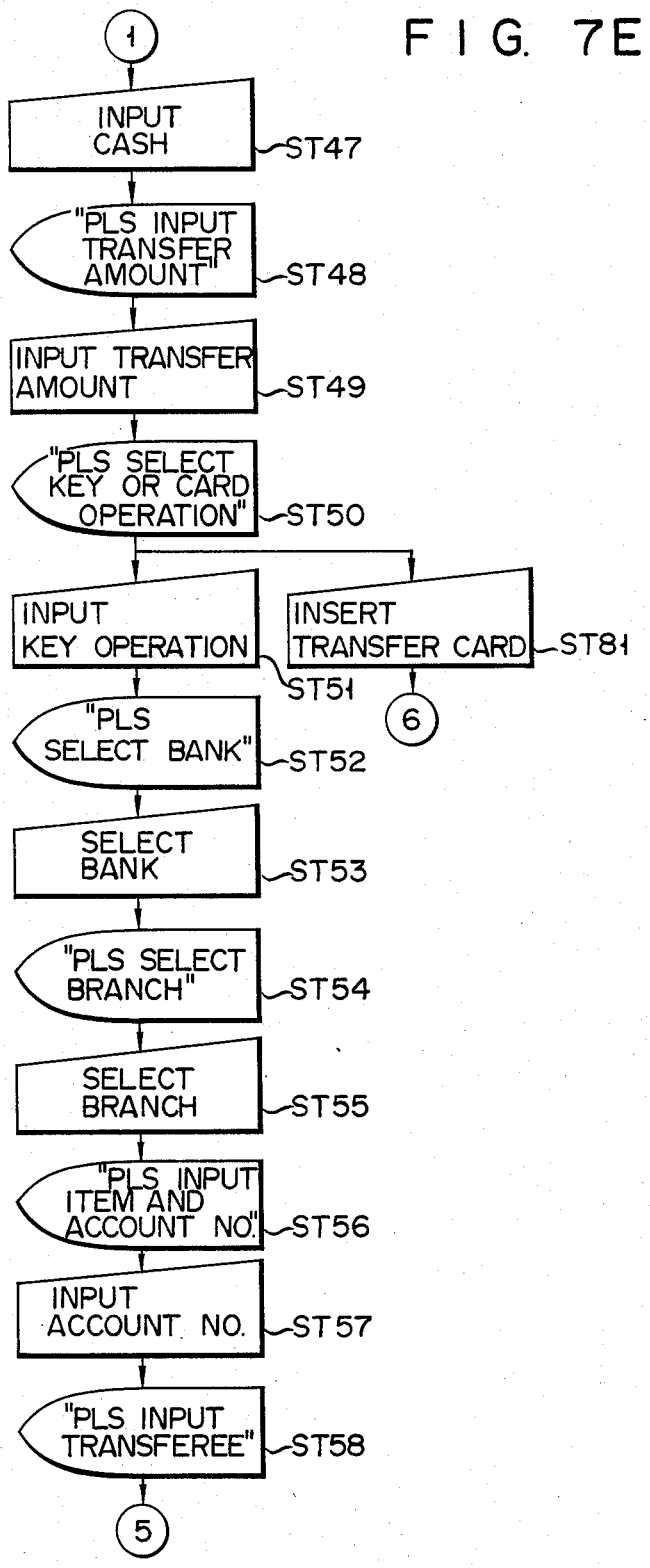
Figure 7F:
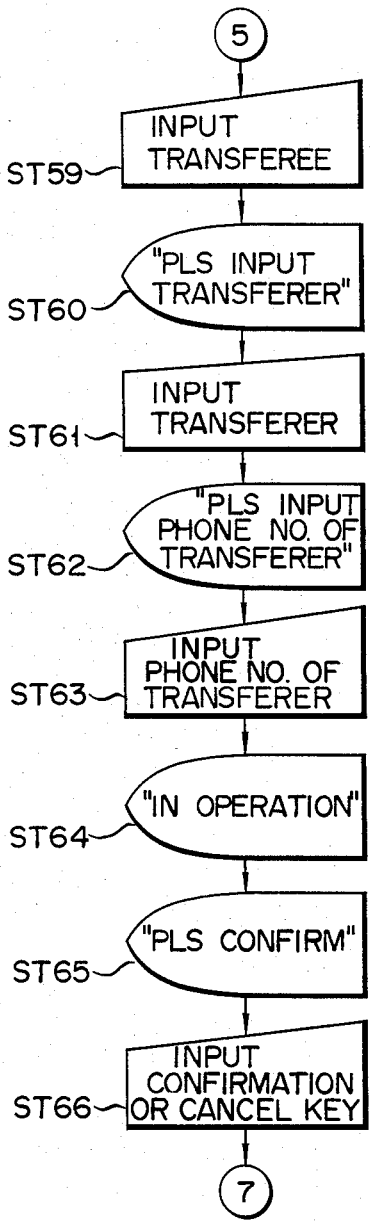
Figure 7G:
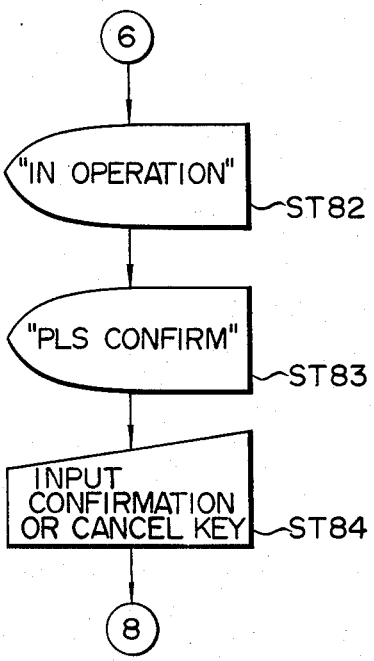
Figure 7H:
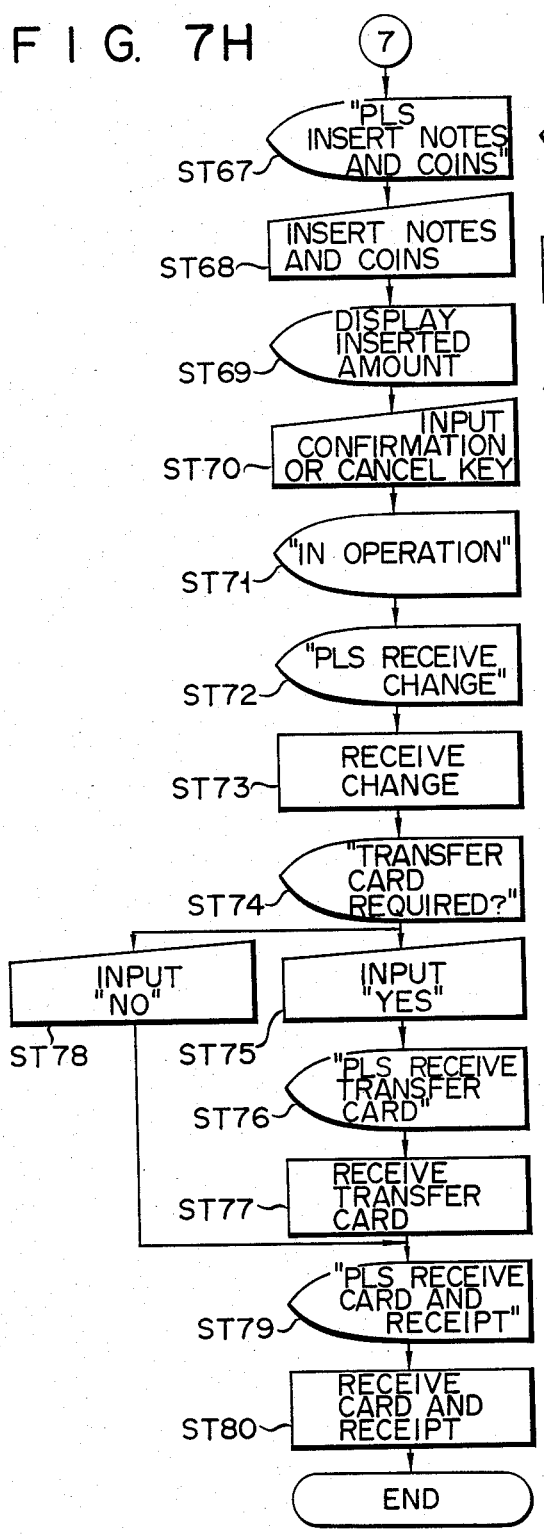
Figure 7I:
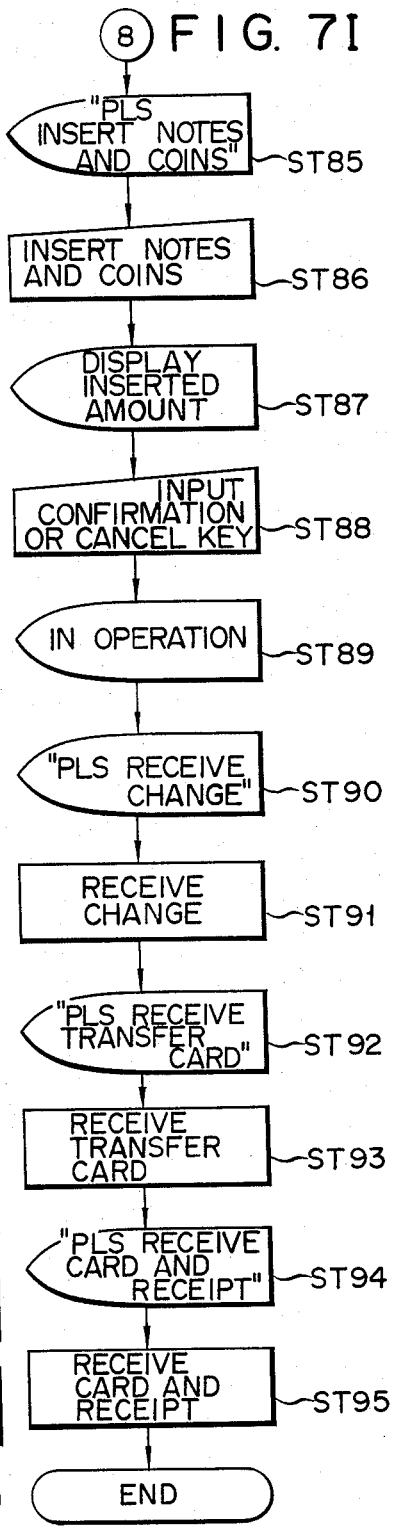

The passbook/transfer card printing section 13 is arranged, as shown in FIG. 6. The passbook/transfer card insertion port 7 communicates with a front end face of a case 42. A photodetector 43 is arranged near the insertion port 7 to optically detect the passbook or transfer card 10 inserted via the port 7. A convey path 44 is formed from the photodetector 43 to the rear portion of the case 42 substantially along the horizontal direction. The convey path 44 is constituted by drive rollers 45, pinch rollers 46 in rolling contact therewith, respectively, guide members 47 and the like. The drive rollers 45 are all driven by a pulse motor 48 through belts, except for the drive roller located at the trailing end of the convey path 44 which is driven by another pulse motor 49. A magnetic head 50 as the MC reader is arranged at the leading edge of the convey path 44. The magnetic head 50 reads information from or writes it in the magnetic stripe 32 of the passbook or the transfer card 10. The magnetic head 50 is brought into contact with the magnetic stripe 32 as needed and is slid along the magnetic stripe (in the direction perpendicular to the convey direction of the passbook or the transfer card 10), thereby performing the information read/write operation.

A platen roller 54 is rotatably supported midway along the convey path 44. An electromagnetic brake 55 as a lock mechanism is coupled to the platen roller 54. The platen roller 54 is locked by the electromagnetic brake 55 while the passbook or transfer card 10 is processed. However, the platen roller 54 is rotated while journal paper 59 is subjected to printing. A printing head 56 is arranged above the platen roller 54. The printing head 56 is held by a carriage 57, and the carriage 57 is guided by a slide rod 58 and moved along the axial direction of the platen roller 54. The platen roller 54 and the printing head 56 constitute a printing unit 76 for printing predetermined information on the passbook, the transfer card 10 or the journal paper 59. The journal paper 59 is wound around the platen roller 54. The roll journal paper 59 is mounted around a supply reel 60 and is taken up by a take-up reel 61 through the platen roller 54. The journal paper 59 is fed by a supply roller 62 and a pinch roller 63. The take-up reel 61 and the supply roller 62 are driven by a pulse motor 64 through the respective belts. A photodetector 65 is arranged in front of the platen roller 54 across the convey path 44 to optically detect a passing passbook or transfer card 10. A passbook stacking box 68 is disposed in the vicinity of the trailing end of the convey path 44 to store the conveyed passbooks.

A transfer card storage section 69 is disposed in the vicinity of the trailing end of the convey path 44 to store new transfer cards 10 which are neither printed nor recorded with the transfer information. The new transfer cards 10 are picked up by a pick-up roller 70 one by one and supplied to the convey path 44.

The transfer transaction processing of the apparatus having the construction described above will be described with reference to the flow charts of FIGS. 7A through 7I. Assume that a customer is standing in front of the automatic transfer transaction processing apparatus. A message "PLEASE SELECT TRANSACTIONS" is displayed at the CRT display unit 5, and at the same time, selection keys for "WITHDRAWAL", "DEPOSIT", "BALANCE ENQUIRY", "PASSBOOK WRITING", and "TRANSFER" are also displayed on the CRT screen (ST1). The customer depresses the TRANSFER key (ST2). The main control section 11 performs the next processing step and causes the CRT display unit 5 to display a message "PLEASE SELECT CASH OR CARD" and at the same time keys for "CASH" and "CARD" are displayed on the screen (ST3). The customer then depresses the "CARD" key in accordance with the message and graphic representations (ST4). The main control section 11 detects that the transfer transaction is to be performed using the card and causes the CRT display unit 5 to display a message "PLEASE INPUT CARD" (ST5). The customer inserts the card through the card inserting/dispensing port 6 in accordance with the instruction (ST6). The card is inserted in the MC reading section 12, so that a magnetic head (not shown) reads account information such as a keycode and an account number from the magnetic stripe 32. The account information is checked by the main control section 11.

When the main control section 11 detects that a wrong card is inserted, the section 11 performs error processing. However, when the main control section 11 detects that the correct card is inserted, the control section 11 causes the CRT display unit 5 to display "PLEASE INPUT KEYCODE", and at the same time, the ten keys and the correction key 84 are illustrated on the CRT screen (ST7). When the customer enters his keycode (ST8), the main control section 11 checks whether or not the keycode coincides with the registered keycode. When no coincidence between the input keycode and the registered keycode is established, the keycode input operation is repeated. However, when coincidence between the input keycode and the registered keycode is established, the main control section 11 causes the CRT display unit 5 to display a message "PLEASE INPUT AMOUNT". At the same time, the ten keys and the amount key are illustrated on the CRT screen (ST9). When the customer enters the amount to be transferred (ST10), the main control section 11 causes the CRT display unit 5 to display a message "PLEASE SELECT KEY OR CARD OPERATION". At the same time, a REGISTRATION key and a transfer card designation key (KEY OPERATION) are displayed on the CRT screen (ST11). The designation key is used for entering new transfer data such as the name of a financial institution and an account number. On the other hand, the registration key is used when the transfer information is already registered.

The customer depresses the designation key in accordance with the message and graphic representations (ST12). When the main control section 11 detects that the designation key is depressed, the section 11 causes the CRT display section 5 to display a message "PLEASE INPUT BANK NAME", and financial institution selection keys are displayed on the screen (ST13). The customer then enters the desired bank name (ST14).

When the customer enters the desired bank name, the main control section 11 checks a list of all bank branches of the specified bank and causes the CRT display section 5 to display a message "PLEASE INPUT BRANCH NAME", and at the same time the branch selection keys are illustrated on the CRT screen (ST15). The customer enters the branch name (ST16). By this selection, the main control section 11 causes the CRT display unit 5 to display a message "PLEASE INPUT ITEM AND ACCOUNT NUMBER". At the same time, the ten keys, the correction key 84, a savings account key and a checking account key are illustrated on the CRT screen (ST17). The customer enters the account number and the transaction item in accordance with the message and the graphic representations (ST18). When the main control section 11 detects that the specified information is correctly entered and that the specified branch is not a main branch, the main control section 11 causes the CRT display unit 5 to display a message "PLEASE INPUT TRANSFEREE". At the same time, the katakana keys 51, the correction key 84, and the end key 85 are illustrated on the CRT screen (ST19). When the customer depresses the end key 85 (ST20), the main control section 11 causes the CRT display unit 5 to display a message "IN OPERATION" (ST21). Thereafter, the main control section 11 exchanges information with a host computer and causes the printing unit 76 to print the information on the journal paper 59. The main control section 11 then causes the CRT display unit 5 to display a message "PLEASE CONFIRM". At the same time, the transfer content, a confirmation key and a cancellation key are graphically displayed on the CRT screen (ST22). The customer thus depresses the confirmation key or the cancellation key (ST23).

When the main control section 11 detects that the cancellation key is depressed, the section 11 performs the canceling process. However, when the main control section 11 detects the confirmation key is depressed, the section 11 causes the CRT display unit 5 to display a message "IN OPERATION" (ST24). The main control section 11 receives electronic funds transfer (EFT) information and causes the printing unit 76 to print this information on the journal paper 59. The main control section 11 then causes the CRT display unit 5 to display a message "TRANSFER CARD REQUIRED?", and at the same time, a YES key and a NO key are graphically illustrated on the CRT screen (ST25). When the customer depresses the YES key in accordance with the message and the graphic representations (ST26) the main control section 11 causes the passbook/transfer card printing/reading section 13 to print the name of the designated financial institution, the branch name, the account number, the item number and the name of the account of the transferee, and the name and the account information of the transferer. These pieces of information are also recorded in the magnetic stripe 32. As a result, the transfer card 10 shown in FIG. 3 is dispensed from the passbook/transfer card insertion port 7.

The new transfer card 10 is removed by the pick-up roller 70 from the storage section 69 and is conveyed along the convey path 44 in a direction indicated by an arrow a. When the trailing end of the transfer card 10 opposes the printing head 56, the transfer card 10 is conveyed in a direction given by an arrow b. In this case, the transfer information is printed by the printing head 56 on an upper surface 31 of the transfer card 10. When printing is finished, the transfer card 10 is conveyed again in the direction indicated by arrow a. When the magnetic stripe 32 opposes the magnetic head 50, the transfer information is recorded in the magnetic stripe 32. Thereafter, the transfer card is dispensed from the port 7. In this case, the main control section 11 causes the CRT display unit 5 to display a message "PLEASE RECEIVE TRANSFER CARD" (ST27). The customer receives the transfer card 10 in accordance with this message (ST28). When the transfer card 10 is received by the customer, or the customer depresses the NO key in step 25 (ST29), the main control section 11 causes the CRT display unit 5 to display a message "PLEASE RECEIVE CARD AND RECEIPT" (ST30). The customer then receives the card and the receipt, and the transfer transaction processing is ended (ST31).

On the other hand, when the registration key is depressed in step 32, the main control section 11 causes the CRT display unit 5 to display a message "IN OPERATION" (ST33). The main control section 11 exchanges information with the host computer and causes the printing unit 76 to print the result on the journal paper 59. The main control section 11 then causes the CRT display unit 5 to display a message "PLEASE CONFIRM". At the same time, the transfer content is displayed and the confirmation key and the cancel key are graphically illustrated on the screen (ST34). The customer has depressed the confirmation key or the cancel key (ST35). When the main control section 11 detects that the customer has depressed the cancellation key, the section 11 performs the canceling process. However, when the main control section 11 detects that the customer has depressed the confirmation key, the section 11 causes the CRT display unit 5 to display a message "IN OPERATION" (ST36). When the main control section 11 receives the electronic funds transfer result, it causes the printing unit 76 to print the result on the journal paper 59. Subsequently, the main control section 11 causes the CRT display unit 5 to display a message "PLEASE RECEIVE CARD AND RECEIPT" (ST37). The customer then receives the transfer card 10 and the receipt (ST38), and the automatic transfer transaction process is ended.

On the other hand, when the transfer card 10 is inserted via the passbook/transfer card insertion port 7 in ST39, the transfer card 10 is inserted in the transfer card printing/reading section 13, and the magnetic head 50 reads the transfer information (i.e., the name of the financial institution, branch name, account number, item number and name of the account of the transferee, and the name and account information of the transferer) from the stripe 32. The read signals are supplied to the main control section 11. The main control section 11 causes the CRT display unit 5 to display a message "PLEASE CONFIRM", and at the same time the transfer content is displayed, and the confirmation and cancellation keys are graphically illustrated on the CRT screen (ST40). The customer depresses the confirmation or cancellation key in accordance with the message and graphic representations (ST41). When the main control section 11 detects that the cancellation key is depressed, the canceling process is executed. However, when the main control section 11 detects that the customer has depressed the confirmation key, the section 11 causes the CRT display unit 5 to display a message "IN OPERATION" (ST42). When the main control section 11 receives the electronic funds transfer information, it causes the printing unit 76 in the transfer card printing/reading section 13 to print the result on the journal paper 59. At the same time, the transfer card 10 inserted in the transfer card printing/reading section 13 is dispensed from the port 7 under the control of the main control section 11. In this case, the main control section 11 causes the CRT display unit 5 to display a message "PLEASE RECEIVE TRANSFER CARD" (ST43). The customer then receives the transfer card 10 in accordance with the message described above (ST44). When the customer has received the transfer card 10, the main control section 11 causes the CRT display unit 5 to display a message "PLEASE RECEIVE CARD AND RECEIPT" (ST45). The customer then receives the card and the receipt (ST46), and the automatic transfer transaction process is ended.

On the other hand, when the customer depresses the CASH portion in ST3, the main control section 11 detects that the customer wishes a cash transfer (ST47). The main control section 11 then causes the CRT display 5 to display a message "PLEASE INPUT TRANSFER AMOUNT", and the ten keys and the amount key are graphically illustrated (ST48). The customer enters a transfer amount in accordance with the message and graphic display (ST49). The main control section 11 then causes the CRT display section 5 to display a message "PLEASE SELECT KEY OR CARD OPERATION". At the same time, the designation key for the KEY OPERATION, which designates the transferee, is graphically displayed on the CRT screen (ST50). The customer depresses the designation key in accordance with the message and graphic display (ST51). When the main control section 11 detects that the customer has depressed the designation key, the section 11 causes the CRT display unit 5 to display a message "PLEASE SELECT BANK". At the same time, the financial institution selection keys are graphically illustrated (ST52). The customer then selects a desired bank (ST53). The main control section 11 then checks a list of branches and causes the CRT display unit 26 to display a message "PLEASE SELECT BRANCH". At the same time, the branch selection keys are graphically illustrated on the CRT screen (ST54). When the customer selects a desired branch (ST55), the main control section 11 causes the CRT display unit 5 to display a message "PLEASE INPUT ITEM AND ACCOUNT NO.". At the same time, the ten keys, the correction key, the savings account key and the checking account key are graphically displayed on the CRT screen (ST56). The customer enters the account number and the item number in accordance with the message and graphic display (ST57). When the main control section 11 detects that the customer has not selected the main branch, the section 11 causes the CRT display unit 5 to display a message "PLEASE INPUT TRANSFEREE". At the same time, the katakana keys, the correction key and the end key are graphically illustrated (ST58). When the customer depresses the end key (ST59), or when the main control section 11 detects that the customer has selected the main branch, the main control section 11 causes the CRT display unit 5 to display a message "PLEASE INPUT TRANSFERER". At the same time, the katakana keys and the end key are graphically displayed (ST60). When the customer types the transferer name and depresses the end key, the main control section 11 causes the CRT display unit 5 to display a message "PLEASE INPUT PHONE NO. OF TRANSFERER". At the same time, the ten keys and the end key are graphically illustrated (ST62). When the customer types the telephone number and depresses the end key (ST63), the main control section 11 causes the CRT display unit 5 to display a message "IN OPERATION" (ST64). When the main control section 11 receives the electronic funds transfer information, it causes the printing unit 76 to print the received information on the journal paper 59. The section 11 then causes the CRT display unit 5 to display a message "PLEASE CONFIRM". At the same time, the transfer content and the graphic representations of the confirmation and cancellation keys are displayed (ST65). The customer depresses the confirmation or cancellation key (ST66) in accordance with the message and graphic display. When the main control section 11 detects that the customer has depressed the cancellation key, the canceling process is executed. However, when the main control section 11 detects that the confirmation key is depressed, the section 11 causes the CRT display unit 5 to display a message "PLEASE INSERT NOTES AND COINS". At the same time, the confirmation and cancellation keys are graphically illustrated (ST67). The customer inserts the bank notes in the bank note insertion port 3 and the coins in the coin insertion port 8 (ST68). The bank notes are received by the note teller 14 and are discriminated and counted. Similarly, the coins are received by the coin teller 15 and are discriminated and counted. When discriminating and counting are finished, the main control section 11 causes the CRT display unit 5 to display the inserted amount (ST69). The customer depresses the confirmation or cancellation key in accordance with the information displayed on the screen (ST70). When the main control section 11 detects that the cancellation key is depressed, the canceling process is executed. However, when the main control section 11 detects that the customer has depressed the confirmation key, the section 11 causes the CRT display 5 to display a message "IN OPERATION" (ST71). When the main control section 11 receives the electronic funds transfer information, the section 11 causes the printing unit 76 to print the result on the journal paper 59. The main control section 11 compares the transfer amount with a withdrawn amount or inserted amount and checks whether or not any small change remains. When the main control section 11 detects that small change remains, the section 11 causes the CRT display unit 5 to display a message "PLEASE RECEIVE CHANGE" (ST72). In this case, the main control section 11 causes the note teller 14 to dispense note change from the note insertion port 3 and the coin teller 15 to dispense coin change from the coin insertion port 9. The customer then receives notes and coins (ST73). When the customer has received the notes and coins, or the main control section 11 detects that no change is left, the main control section 11 causes the CRT display section 5 to display a message "TRANSFER CARD REQUIRED?". At the same time, the YES and NO keys are graphically displayed (ST74). When the customer depresses the YES key in accordance with the message and the graphic display (ST75), the main control section 11 causes the transfer card printing/reading section 13 to print, as the transfer information, the bank name, branch name, account number, item number and the name of the account of the transferee, and the name and phone number of the transferer on a new transfer card 10. The transfer card 10 (FIG. 4) having the magnetic stripe 32 recorded with transfer information is then dispensed from the port 7. In this case, the main control section 11 causes the CRT display unit 5 to display a message "PLEASE RECEIVE TRANSFER CARD" (ST76). The customer then receives the transfer card 10 (ST77). When the transfer card 10 has been received by the customer or the customer depressed the NO key in ST78, the main control section 11 causes the CRT display unit 5 to display a message "PLEASE RECEIVE CARD AND RECEIPT" (ST79). The customer then receives the card and receipt (ST80), and the automatic transfer transaction process is ended.

When the customer inserts the transfer card 10 in the passbook/transfer card insertion port 7 (ST81) in accordance with the display in ST50, the transfer card 10 is inserted in the transfer card printing/reading section 13, and the magnetic head 50 reads the transfer information (i.e., the bank name, branch name, account number, item number and name of the account of the transferee, and the name and phone number of the transferer) from the stripe 32. The main control section 11 then causes the CRT display unit 5 to display a message "IN OPERATION" (ST82). The main control section 11 receives the electronic funds transfer result and then causes the printing unit 76 to print the result on the journal paper 59. The main control section 11 then causes the CRT display unit 5 to display a message "PLEASE CONFIRM", and the transfer content and the graphic representations of the confirmation and cancellation keys are displayed (ST83). The customer enters the confirmation or cancellation key in accordance with the message and graphic display (ST84). When the main control section 11 detects that the cancellation key is depressed, the canceling process is executed. However, when the main control section 11 detects that the customer has depressed the confirmation key, the section 11 causes the CRT display unit 5 to display the message "PLEASE INSERT NOTES AND COINS", and the confirmation and cancellation keys are graphically displayed (ST85). The customer inserts the notes in the bank note insertion port 3 and the coins in the coin insertion port 8 (ST86). The notes are received by the note teller 14 and are discriminated and counted. Similarly, the coins are received by the coin teller 15 and are discriminated and counted. When discriminating and counting are finished, the main control section 11 causes the CRT display unit 5 to display the inserted amount in ST87. The customer depresses the confirmation or cancel key in accordance with the message and graphic display (ST88). When the main control section 11 detects that the cancellation key is depressed, the canceling process is executed. However, when the main control section 11 detects that the customer has depressed the confirmation key, the section 11 causes the CRT display section 5 to display the message "IN OPERATION" (ST89). When the main control section 11 receives the electronic funds transfer information, it causes the printing unit 76 to print the result on the journal paper 59. The main control section 11 compares the transfer amount with the withdrawn amount or inserted amount and checks whether or not change is left. When the main control section 11 detects that change is left, the section 11 causes the CRT display unit 5 to display the message "PLEASE RECEIVE CHANGE" and the amount of change (ST90). In this case, the main control section 11 causes the note teller 14 to dispense the bank notes to the port 3 and the coin teller 15 to dispense the coins to the port 9. The customer then receives the change (ST91). When the customer has finished receiving change or the main control section 11 detects that no change is left, the main control section 11 causes the CRT display unit 5 to display the message "PLEASE RECEIVE TRANSFER CARD" (ST92). The customer then receives the transfer card 10 (ST93). When the customer has received the card 10, the main control section 11 causes the CRT display unit 5 to display the message "PLEASE RECEIVE CARD AND RECEIPT" (ST94). The customer thus receives the card and the receipt (ST95), and the automatic transfer transaction process is ended (ST95).

What is claimed is:

1. An automatic transfer transaction processing apparatus comprising:

input means for entering transfer information;

transfer transaction processing means for performing the transfer transaction process in accordance with the transfer information entered at said input means;

card-like medium issuing means for issuing a card-like medium having at least part of the transfer information entered at said input means when the transfer transaction process is finished; and reading means for reading the card-like medium.

2. An apparatus according to claim 1, wherein the transfer information stored in said card-like medium comprises at least transferee information and transferer information.

3. An apparatus according to claim 1, further comprising:

an identification card reader for reading information from an identification card having at least account information; and means for selectively recording and printing, as transferer information, the account information of the identification card when the transfer transaction process is performed by using the identification card, and as the transferer information operation information entered by said input means when the transfer transaction processing is performed by using cash, and for issuing the card-like medium.

4. An apparatus according to claim 2, further comprising:

an identification card reader for reading information from the identification card having at least account information; and means for selectively recording and printing, as transferer information, the account information of the identification card when the transfer transaction process is performed by using the identification card, and as the transferer information operation information entered by said input means when the transfer transaction process is performed by using cash, and for issuing the card-like medium.

5. An apparatus according to claim 1, wherein the card-like medium has a magnetic stripe for recording the transfer information.

6. An apparatus according to claim 3, wherein the card-like medium has a magnetic stripe for recording the transfer information.

* * * * *